US005733422A

United States Patent [19]

Lin

[11] Patent Number: 5,733,422

[45] Date of Patent: Mar. 31, 1998

[54] HIGH-PRESSURE GAS PRODUCING ELECTROLYSIS TANK

[76] Inventor: I-Chuan Lin, No.53, Yueh-Mei Tan, Yueh-Mei Tsun, Hsin Kang Hsiang, Chia-Yi Hsien, Taiwan

[21] Appl. No.: 808,105

[22] Filed: Feb. 28, 1997

[51] Int. Cl.[6] ..... C25B 9/00; C25B 15/02

[52] U.S. Cl. ..... 204/229; 204/230; 204/240; 204/241; 204/258

[58] Field of Search ..... 204/229, 230, 204/240, 241, 258

[56] References Cited

U.S. PATENT DOCUMENTS

| | | | |
|---|---|---|---|
| 4,002,552 | 1/1977 | Bunn, Jr. et al. | 204/230 X |
| 4,113,601 | 9/1978 | Spirig | 204/230 |
| 4,369,102 | 1/1983 | Galluzzo et al. | 204/258 X |
| 4,726,888 | 2/1988 | McCambridge | 204/270 X |
| 5,037,518 | 8/1991 | Young et al. | 204/230 |
| 5,614,069 | 3/1997 | Lin | 204/270 X |

*Primary Examiner*—Donald R. Valentine
*Attorney, Agent, or Firm*—Browdy and Neimark

[57] ABSTRACT

A gas producing high pressure electrolysis tank in combination with a water tank and pressure control and recollection valve units is capable to fill and recollect electrolyte automatically in the process of gas production. The electrolysis tank has good heat dissipation effect and is divided into a plurality of densely spaced electrolysis cells so as to make the electrolysis efficiency and pressure high.

6 Claims, 13 Drawing Sheets

HIGH-PRESSURE GAS PRODUCING ELECTROLYSIS TANK

BACKGROUND OF THE INVENTION

The present invention relates to a high-pressure gas producing electrolysis tank for use in safe generation of gas for commercial purpose.

In general, conventional gas production equipments produce gases by way of electrolysis in which the chemicals in various kinds of electrolyte will be electrolyzed so as to produce pure gases separately that are collected at last via collection procedures. The crucial factors effecting the efficiency of an electrolytic process are the concentration of an electrolyte, the material of the electrode plates, temperature, pressure of its operation environment and the distance between the electrode plates and etc. Control of the concentrations of electrolytes, the material of electrode plates and temperature of its operation environment can be easily achieved. However, the problem of inadequancy of pressure in a positive electrode chamber or negative electrode chamber (even it takes place for only a moment) is not tackled with ease, resulting in an irreversible damage to the partition boards in the electrolysis tank and in final sabotage of the whole electrolysis equipment.

Moreover, the inadequancy of pressure in the electrolysis tank results in the generation of air bubbles among electrode plates in a gas producing electrolytic process. The air bubbles will increase the electric resistance in the electrolysis, making the efficiency thereof decrease greatly. It becomes a common rule that the more air bubbles exist, the less efficient an electrolytic process becomes. If the bulk phase of an electrolysis has an electric resistance coefficient $\rho\theta$, and the bubble distribution layer has an electric resistance coefficient of $\rho$, and the resistance amplifying factor is f equal to $\rho/\rho\theta$. The maximum value of f can reach 6 in case of the bubbles being distributed in a rotary ellipse-shaped area. If the bubbles scattered in a bubble distribution area has a volumetric ratio (vacancy ratio), then the relation between the above factors is established as follows: $f=\rho/\rho\theta=(1-\epsilon)^{-1.5}$.

Furthermore, if the distance between two electrode plates is excessively large, the electric voltage for the electrolytic process must be increased accordingly in such a manner that the loss of electrolytic effect will boost up at the same time. The conventional electrode plates are secured in place by metallic rods leading therethrough (space must be taken into account in assembly), resulting in a bulky size of the electrolysis tank.

To acquire a sound efficiency in an electrolytic process, the pressure in an electrolysis tank, the distance between two electrode plates must be properly controlled. But, it is quite difficult to achieve the goal by conventional techniques.

SUMMARY OF THE INVENTION

The primary object of the present invention is to provide a high pressure gas producing electrolysis tank in combination to a pressure control and recollection valve means so as to recycle electrolyte effectively.

Another object of the present invention is to provide a high pressure gas producing electrolysis tank having two mounting plates which are provided with a plurality of retaining ditches thereon for securing a plurality of partition diaphragms in place for dividing the degasing chambers of the electrolysis tank in a more effective manner so as to keep the operation pressure in the tank under proper level in spite of the high pressure generated in the tank resulting from reducing of the size of the tank and raising electrolytic efficiency.

The present invention has the following advantages given as below:

1. The pressure control and recollection valve means can condense the vapor in the produced gas and recollect electrolyte which can be recycled and automatically fed into the electrolysis tank so as to simplify the operation thereof;

2. The electrode plates are separated and secured in place by the retaining ditches on the two mounting plates so that the distance between two electrode plates can be minimized, making the assembly simple in one aspect and permitting a small volumed electrolysis tank to produce the same effect as in a large tank in another aspect (the present invention can accommodate 50 electrode plates in a 68-centimeter tank). Thus, the size of an electrolysis tank can be tremendously reduced and the efficiency of an electrolysis can be raised, permitting electrolyte to produce gas under high pressure without generating bubbles in operation.

3. The present invention can easily effect control of the pressure in an electrolysis tank and the distance between electrode plates and the fixing of the plates.

DETAILED DESCRIPTION OF THE PREFERRED EMBODIMENT

Figure 1:
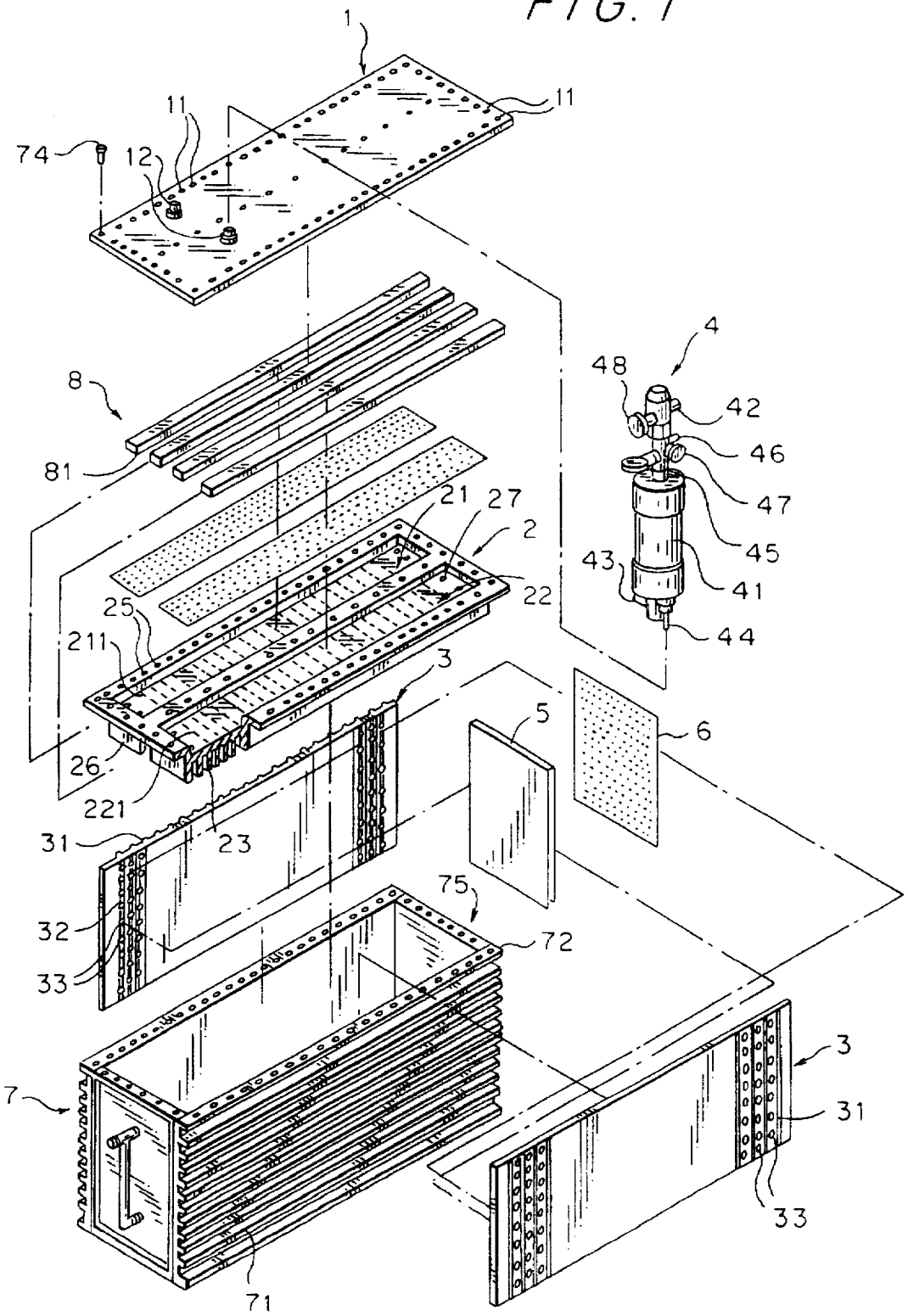
FIG. 1 is a perspective diagram showing the exploded components of the present invention.

Referring to FIG. 1, the present invention is a high pressure gas producing electrolysis tank mainly comprising a top cover 1, a hood bracket 2, a pair of mounting plates 3, a pressure control and recollection valve units 4, a plurality of electrode plates 5, a plurality of partition diaphragms 6, a tank embodiment 7, a filter layer 8 and a water container 9.

The top cover 1 of a rectangular shape has a plurality of screw holes 11 disposed on two pairs of parallel edges and the axial middle line 10 thereof. The outlet disposed on each side of the axial middle line 10 for mounting of a check valve 12 respectively.

The hood bracket 2 has a left and right degasing chamber 21, 22 on the top portion thereof that are not in communication with each other. The hood bracket 2 has a plurality of downwardly protruded ribs 23 forming a plurality of receiving grooves among one another. It further has a plurality of spaced screw holes 25 disposed all over a peripheral flange thereof and a central division column 20 having a plurality of screw holes disposed thereon that correspond to the screw holes 11 on the top cover 1. The left and right degasing chambers 21, 22 have a plurality of degasing slots 211, 221 defined at each bottom face thereof respectively. The peripheral flange forming a surrounding wall 26 enclosing the downwardly protruded ribs and receiving grooves. At each short side of the left and right degasing chambers 21, 22 are disposed a plurality of recycling holes 27.

Figure 4A:
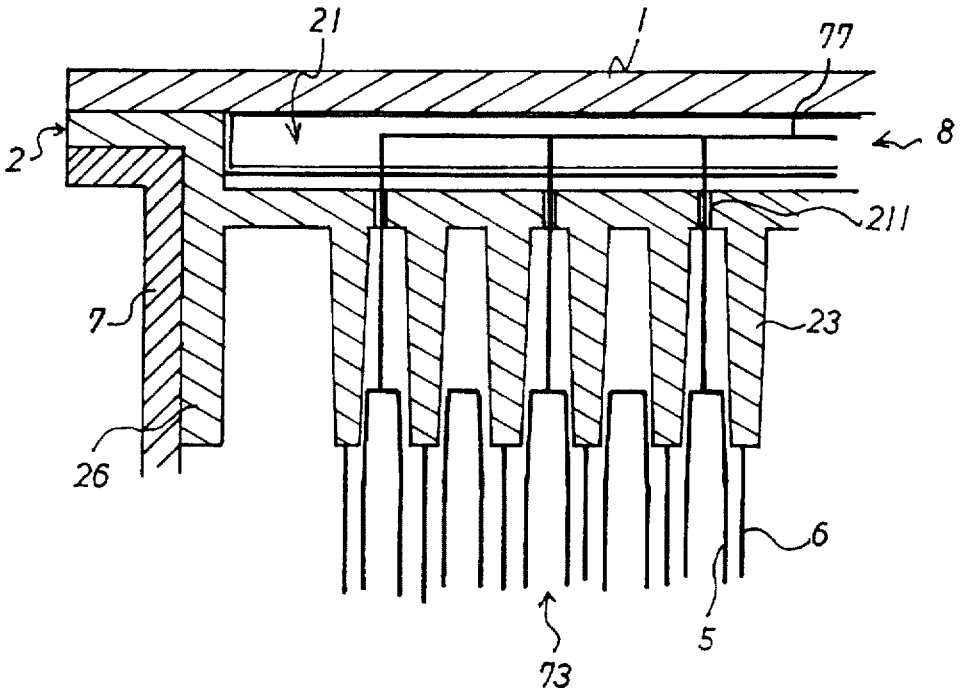
FIGS. 4A, 4B are sectional diagrams showing the structure of the present invention.
Figure 4B:
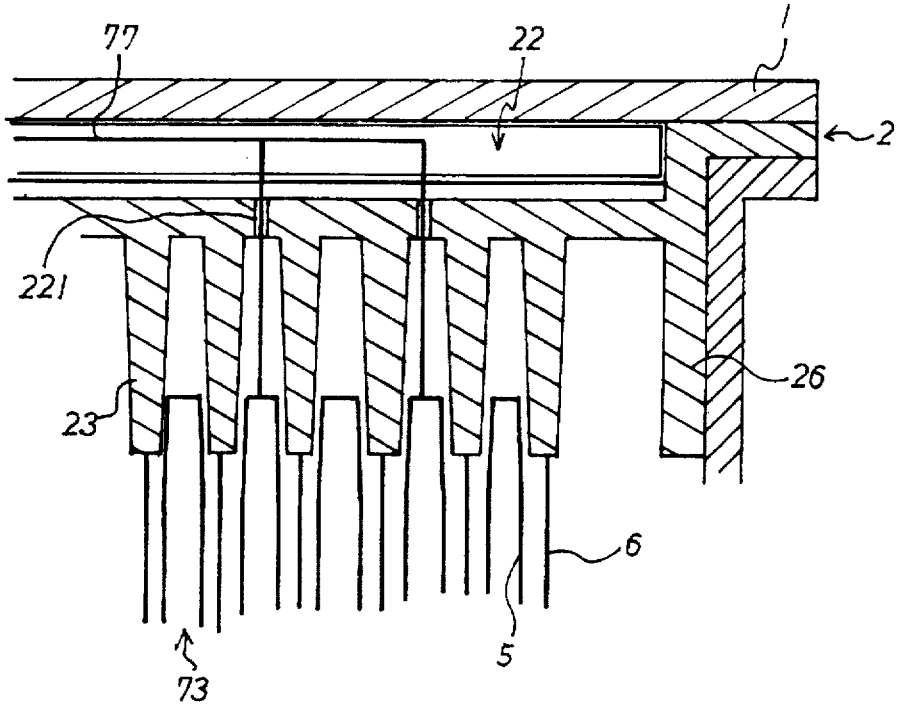
Figure 5:
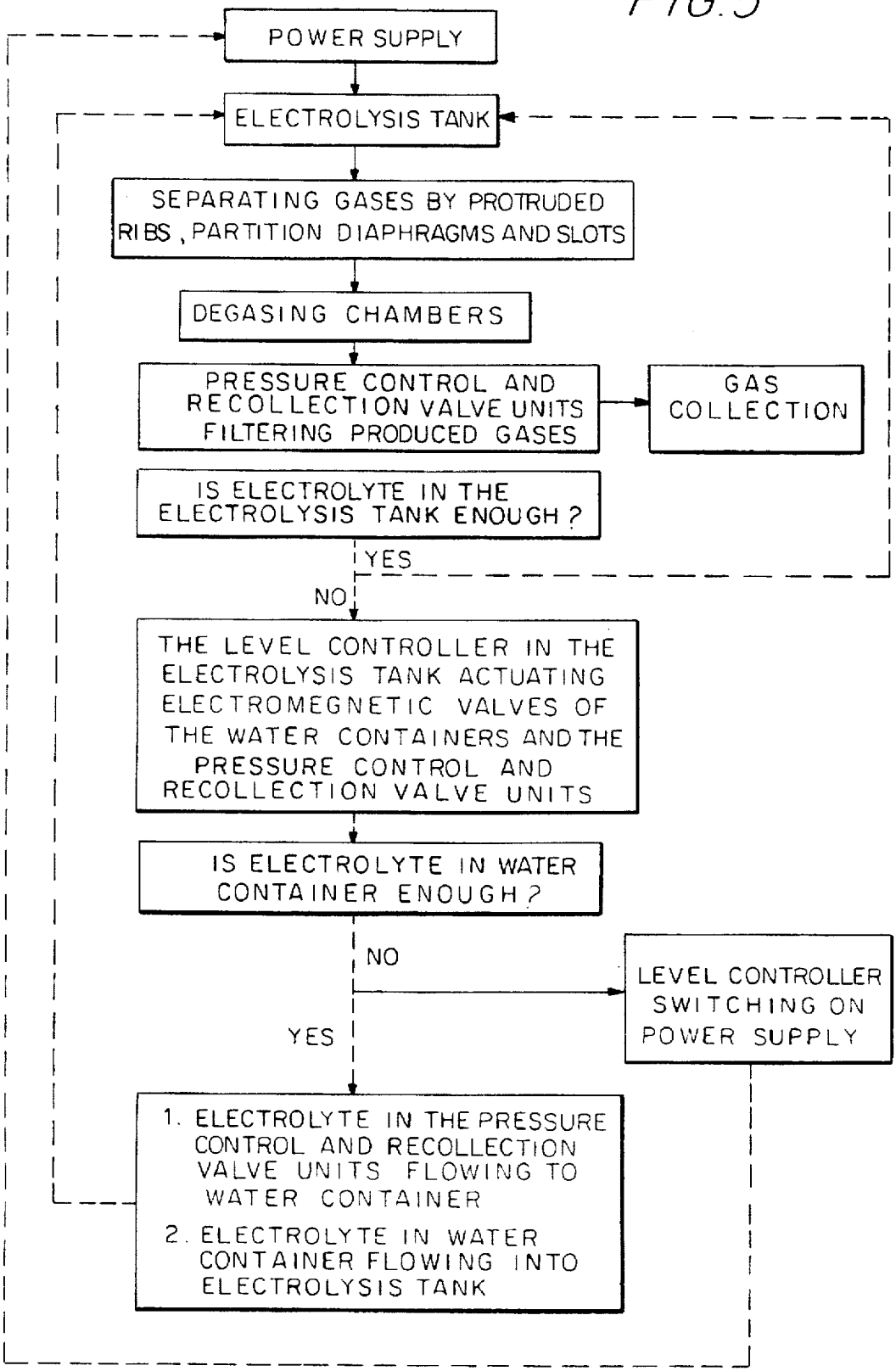
FIG. 5 is a block diagram showing the flow chart of the present invention.

The degasing slots 211, or 221 are placed in correspondence to every other of the receiving grooves 28, as shown in FIGS. 4A, 4B. A plurality of electrode plates 5 each symmetrically folded into a clip form for saving material.

A plurality of partition diaphragms 6 each disposed under the protruded ribs 23 and consecutively next to electrode plates 5 alternatively in assembly with the top of the electrode plates 5 housed in the receiving grooves 28 of the hood bracket 2 and the partition diaphragms 6 located just under the downwardly protruded ribs 23 in an end-to-end abument relation.

A pair of mounting plates 3 each having a plurality of spaced vertical ribs 31 with a plurality of corresponding retaining ditches 32 forming among the vertical ribs 31 for mixedly housing the electrode plates 5 and the partition diaphragms 6 alternatively. A plurality of horizontal through holes 33 each bridging a pair of neighboring vertical ribs 31. Each mounting plate 3 is placed at one side of the electrolysis tank 7.

The electrolysis tank 7 is a container and has a plurality of heat dissipating fins 71 on external walls thereof and has a plurality of screw holes 72 disposed on the peripheral edge of the tank 7. The tank 7 has an electrolyte passing hole (not shown) on one side thereof and a level controller 75 (not shown) disposed near the top of one side wall with an electro-magnetic valve (not shown) and a pressure reducing valve (not shown) at the bottom of the same side.

A filter layer 8 including a pair of filter blocks 80 made of porous material each disposed on top of each the left and right degasing chambers 21, 22 respectively are retained in place by strips of weight block 81.

Pressure control and recollection valve units 4 each having a filter container 41 to the top of which are mounted a pressure control valve 42, a pressure relief valve 46, a pressure operated switch 47, a pressure gauge 48, explosion-proof outlet 45. At the bottom thereof is further disposed a check valve controlled gas inlet 44 and an electromagnetic valve 43 connected to the water tank 9. The pressure operated switch 47 automatically cuts off the general electric power supply as a pressure differential is applied thereto.

The water tank 9 containing an electrolyte therein is disposed between the electrolysis tank 7 and the pressure control and recollection valve units 4 and is provided with a level control means 91 inside thereof for regulating the level of the electrolyte therein. An electromagnetic valve 43 is disposed at the outlet of the tank 9. As the level control means 91 detects inadequacy of electrolyte in the tank 9, the general power supply is cut off at once.

In assembly, the mounting plates 3 are first secured in place to the right and left inner sides of the electrolysis tank 7 respectively with the retaining ditches 32 of the two mounting plates 3 in face-to-face alignment with each other, then the electrode plates 5 and the partition diaphragms 6 are placed in the retaining ditches 32 alternately in parallel to one another. To the bottom of each symmetrically folded electrode plate 5 are attached cushion members 76 so as to create a closed area.

Next, the hood bracket 2 with its flanged surrounding wall 26 is topped over the opening of the electrolysis tank 7 with the downwardly protruded ribs 23 of the hood bracket 2 in connection to the partition diaphragms respectively so as to form a plurality of cells 73 for housing the electrode plates separately. The top of each electrode plate 5 extends over the bottom edge of the protruded ribs 23. The top level of electrolyte is over the top of the electrode plate 5 and is under the right and left degasing chambers 21, 22. The arrangement of the degasing slots 211 of the degasing chamber 21 and the degasing slots 221 of the degasing chamber 22 is such that the slots 211 and the slots 221 are alternately positioned with one another, as shown in FIG. 4A, 4B. In other words, each slot 211 and slot 221 alternately come in registration with a different electrode plate 5.

Figure 2:
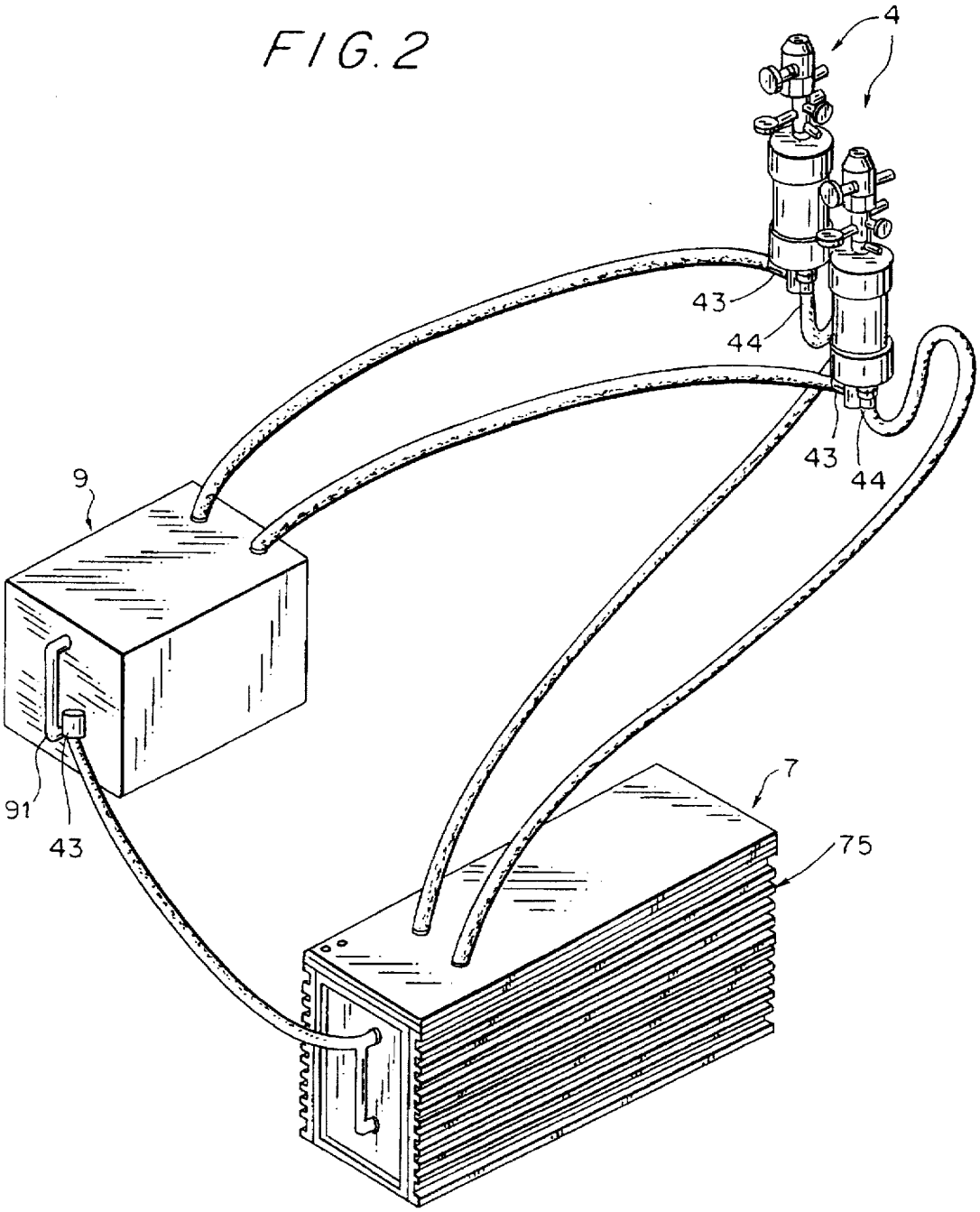
FIG. 2 is a diagram showing a practical application of the present invention.
Figure 3:
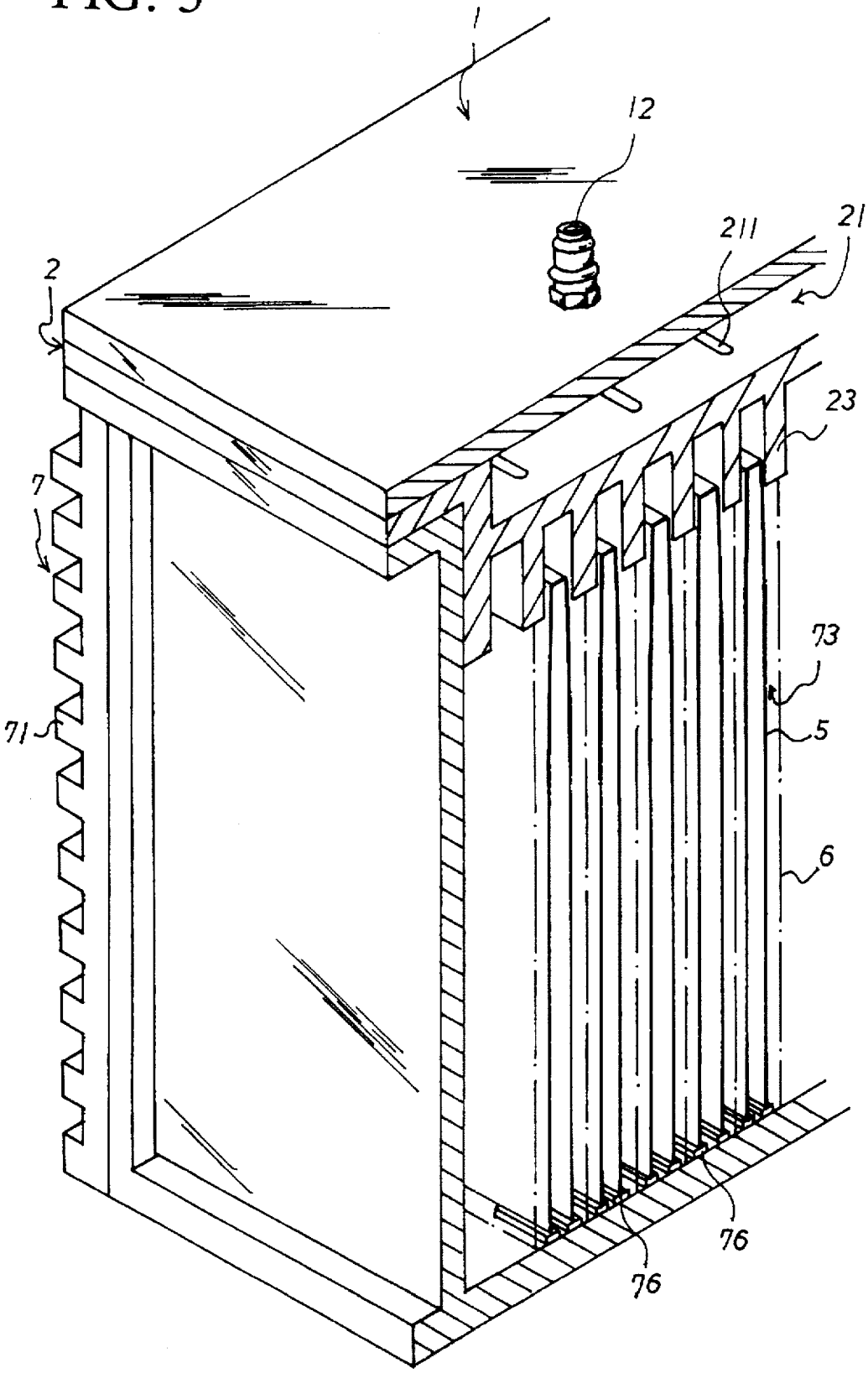
FIG. 3 is a partially sectional view of the present invention.

A set of electrode plates 5 in registration with the degasing slots 211 of the left degasing chamber 21 are electrically coupled in parllel in the same manner as the other set of electrode plates 5 in registration with the degasing slots 221 of the right degasing chamber 22 by way of coupling wires 77 specially processed to keep it insulated and corrosion-proof and led through the filter layers 8 to extend into the degasing chambers 21, 22 respectively. Then, the top cover 1 is secured to the hood bracket 2 by way of screws 74 led through the screw holes 11 of the top cover 1 and the screw holes 25 of the hood bracket 2 and the screw holes 72 of the electrolysis tank 7. The water tank 9 is connected to the pressure control and recollection valve units 4 by tubes **40*a* one end of which is coupled to the electromagnetic valve 43 of the unit 4 and the other end coupled to the water tank 9. The check valves 12 of the electrolysis tank 7 are connected to the inlets 44 of the units 4 by way of tubes 40*b*, as shown in FIGS. 2, 3**.

In practical operation, as the electrode plates 5 coupled in parallel by wires 77 led through the degasing slots 211, 221, are supplied with electrical power, the electrolyte, such as NaCl, there is an electrolysis cell 73 formed between each pair of electrode plate 5 as a result of the parallel connection of the plates. The positive electrode plates 5 will attract the negative ions in the electrolyzed solution to generate chlorine gas and the negative electrode plates 5 will produce hydrogen gas (forming NaOH solution due to the partition diaphragms). The produced gases confined in respective cells 73 formed by the diaphragms 6 and the protruded ribs 23 will be led into the left degasing chamber 21 via the slots 211 and into the right degasing chamber 22 via the slots 221 respectively.

The protruded ribs 23 stick into the electrolyte so that the space above the electrolyte and the ribs 23 can accommodate relatively high pressure electrolytic gases therein. At this moment, the filter layer 8 will remove moisture in the gases passing therethrough first time, and the moisture will be condensed into electrolyte again and be recollected via the degasing slots 211, 221 and the recycling holes 27 into the electrolysis cells 73.

The gases filtered by the filter layer 8 led through the check valves 12 and into the pressure control and recollection valve units 4 are filtered the second time in the filter tanks 41 so that gases with moisture can be finely filtered to produce dry gases and released via the pressure controlled valves 42 for collection. The condensed moisture will be collected in the filter tanks 41 in the form of electrolyte.

As the level of the electrolyte in the tank 7 is checked by a level controller 75 to be inadequate, the electromagnetic valves 43 of the filter tanks 41 and the water tank 9 will be opened to let the electrolyte in the filter tank 41 flow into the tank 9 and the electrolyte in the tank 9 flow further into the electrolysis tank 7 automatically to fill the same to a fixed level. Since the filter ta.

Figure 6A:
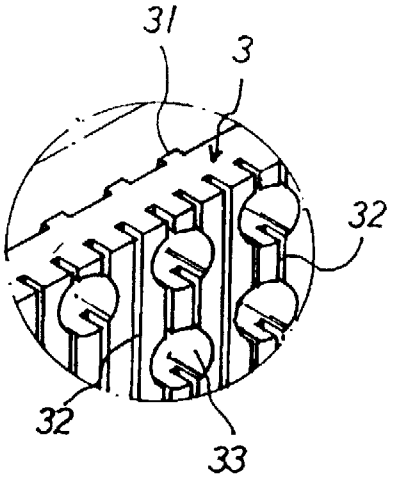
FIG. 6A is an enlarged view of circled area 6A in FIG. 6.
Figure 6:
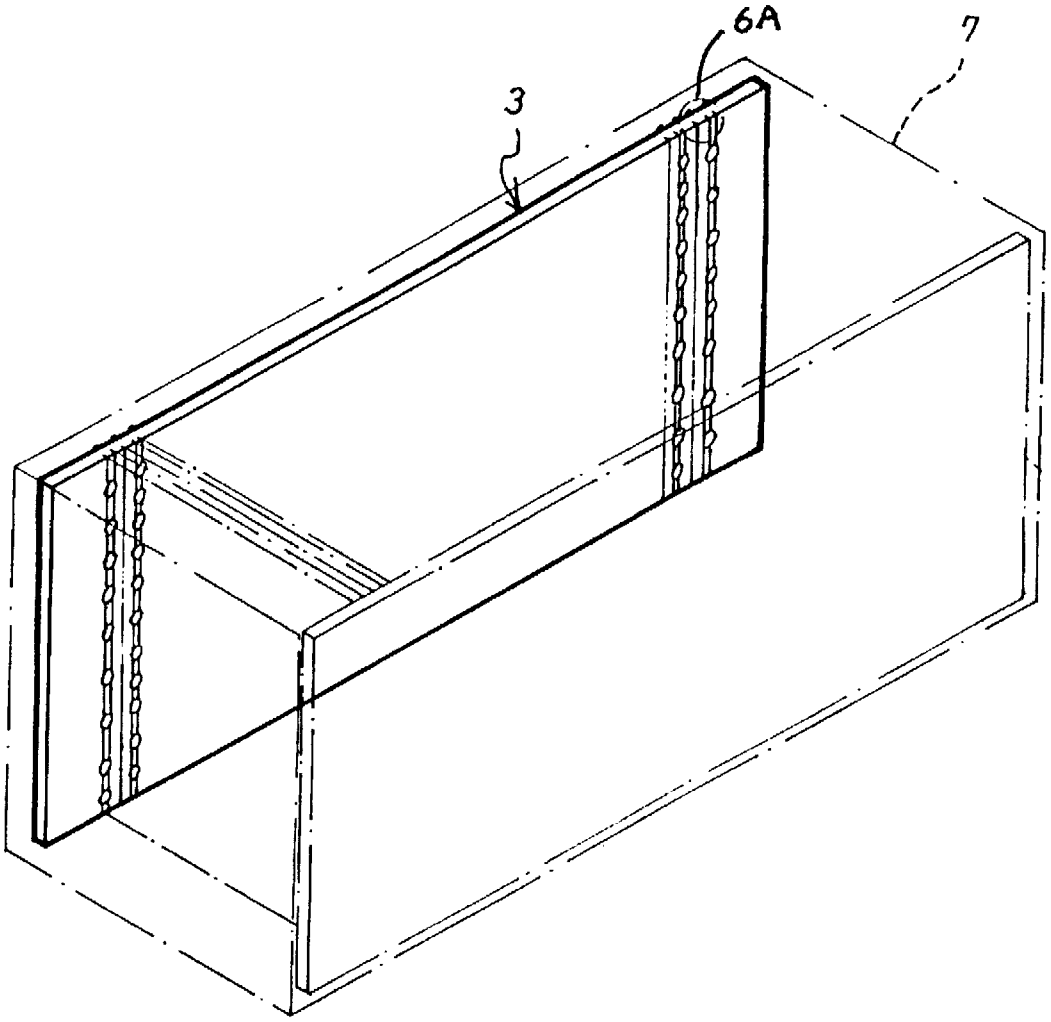
FIG. 6 illustrates the detailed structure of one of two mounting boards.

As the level of the electrolyte in the tank 7 is checked by a level controller 75 to be inadequate, the electromagnetic valves 43 of the filter tanks 41 and the water tank 9 will be opened to let the electrolyte in the filler tank 41 flow into the tank 9 and the electrolyte in the tank 9 flow further into the electrolysis tank 7 automatically to fill the same to a fixed level. Since the filter taof electrolysis cells 73 so as to effectively reduce the volume of the tank 7 and increase the electrolytic areas of the electrode plates 5. As a result of fast electrolytic reaction taking place in the cells 73 of the tank 7, a high pressure will be constantly maintained in the tank 7, effectively preventing bubbles produced therein. The heat produced in the electrolytic process can be dissipated via the through holes 33 of the mounting plates 3 and the wall of the electrolysis tank 7 directly. The electrolyte in the cells 73 is confined in the room of the vertical ribs 31 and the inner wall of the electrolysis tank 7, as shown in FIGS. 6, 6A.

Figure 7:
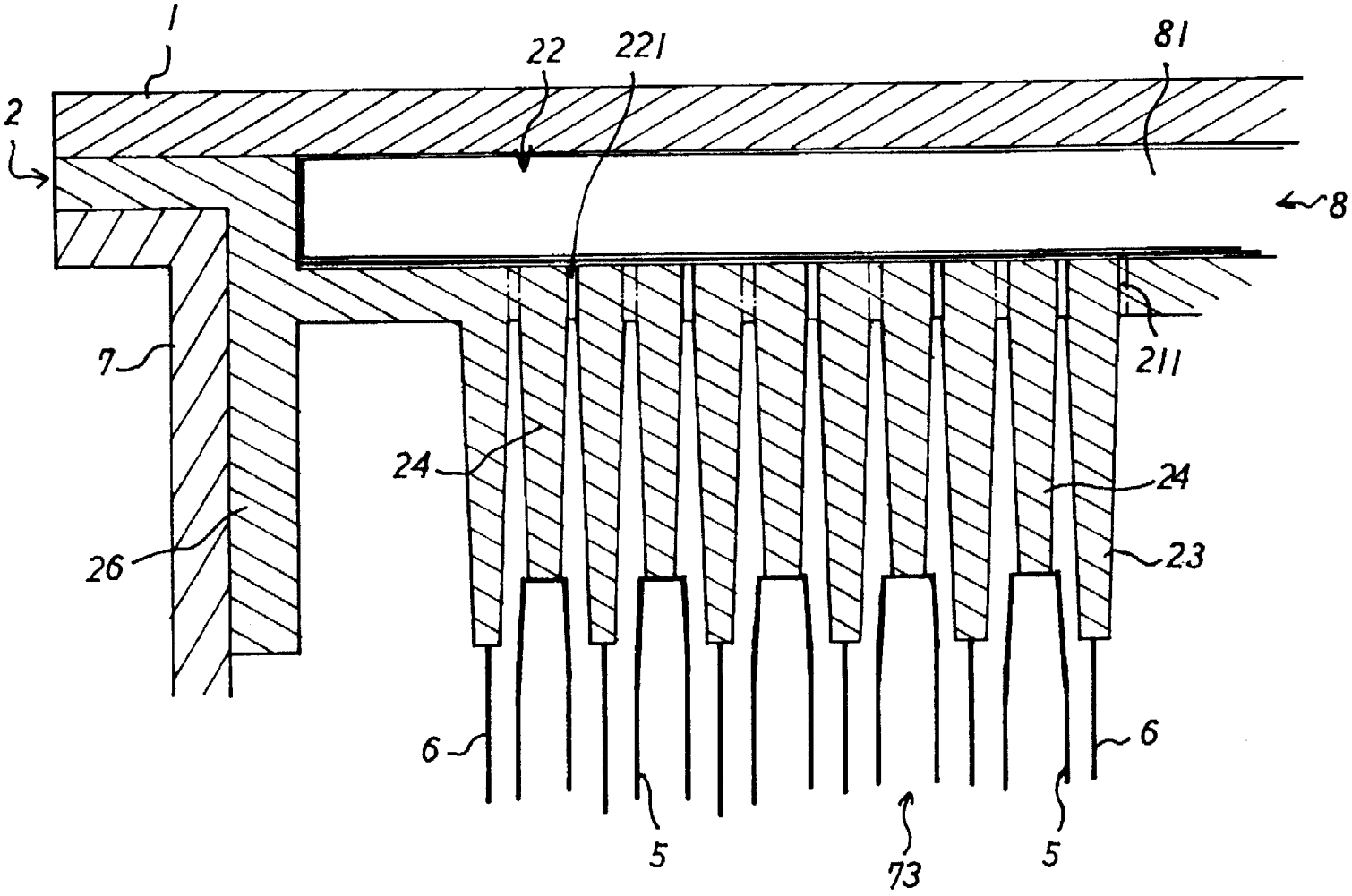
FIG. 7 is a plane sectional view showing the detailed structure of another embodiment of the present invention.

Moreover, in another embodiment of the present invention, when the electrode plates 5 of the present invention are serially connected, the hood bracket 2 is additionally provided with a plurality of retaining ribs 24 disposed between every two protruded ribs 23 so as to make the left degasing slots 211 and the right degasing slots 221 and the protruded ribs 23 and the retaining ribs 24 to form consecutive spaces. After the hood bracket 2 is secured to the electrolysis tank 7, the bottom of the retaining ribs 24 abut against the tops of the electrode plates 5 respectively so that the electrolyzed gases in the positive electrode plates 5 and the negative electrode plates can be released via the degasing slots 211, 221 and the pressure control and recollection valve units 4 and the electrolyte is recollected as shown in FIG. 7.

Figure 8:
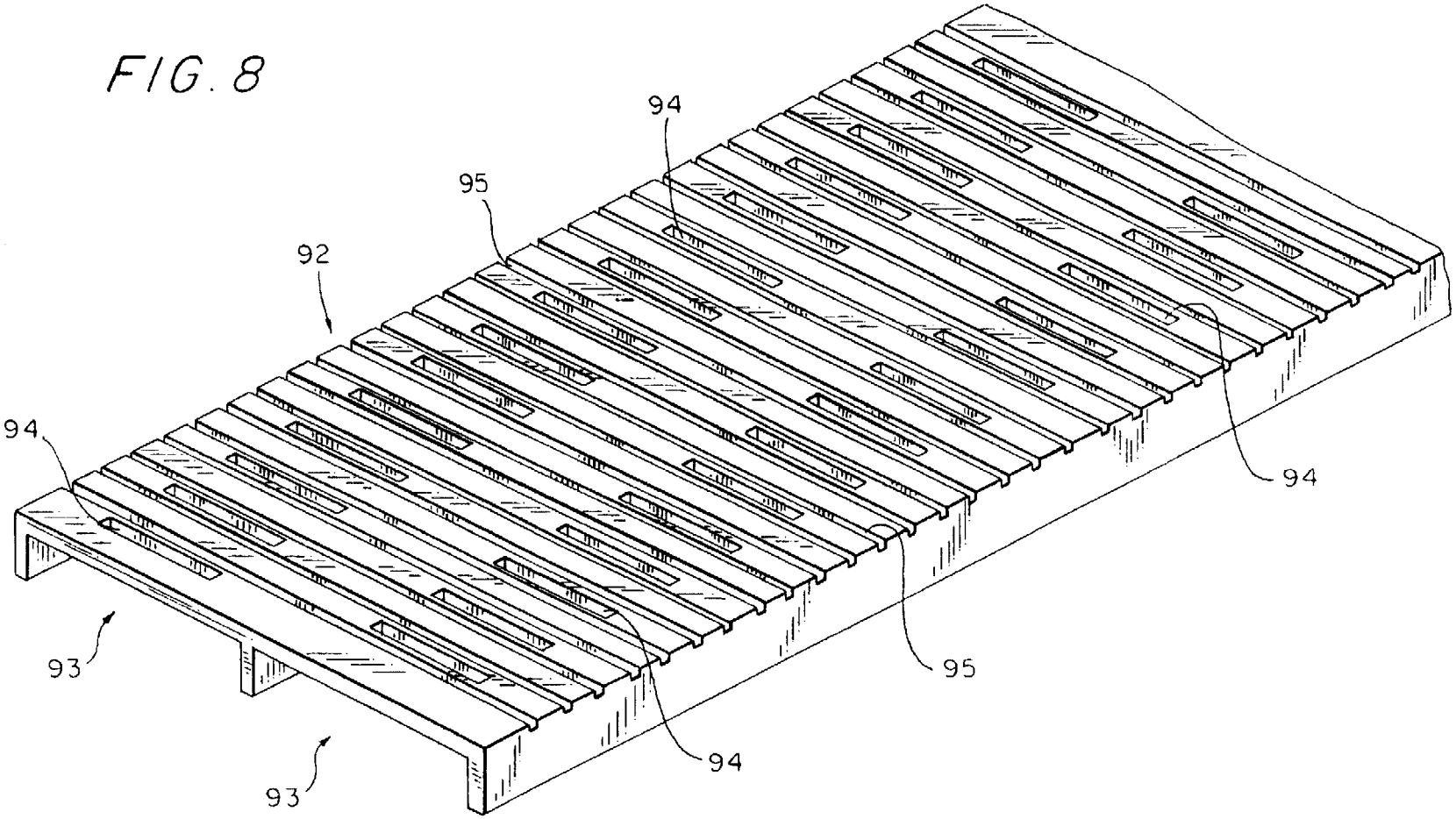
FIG. 8 is a diagram showing the structure of a separating board of the present invention.
Figure 9:
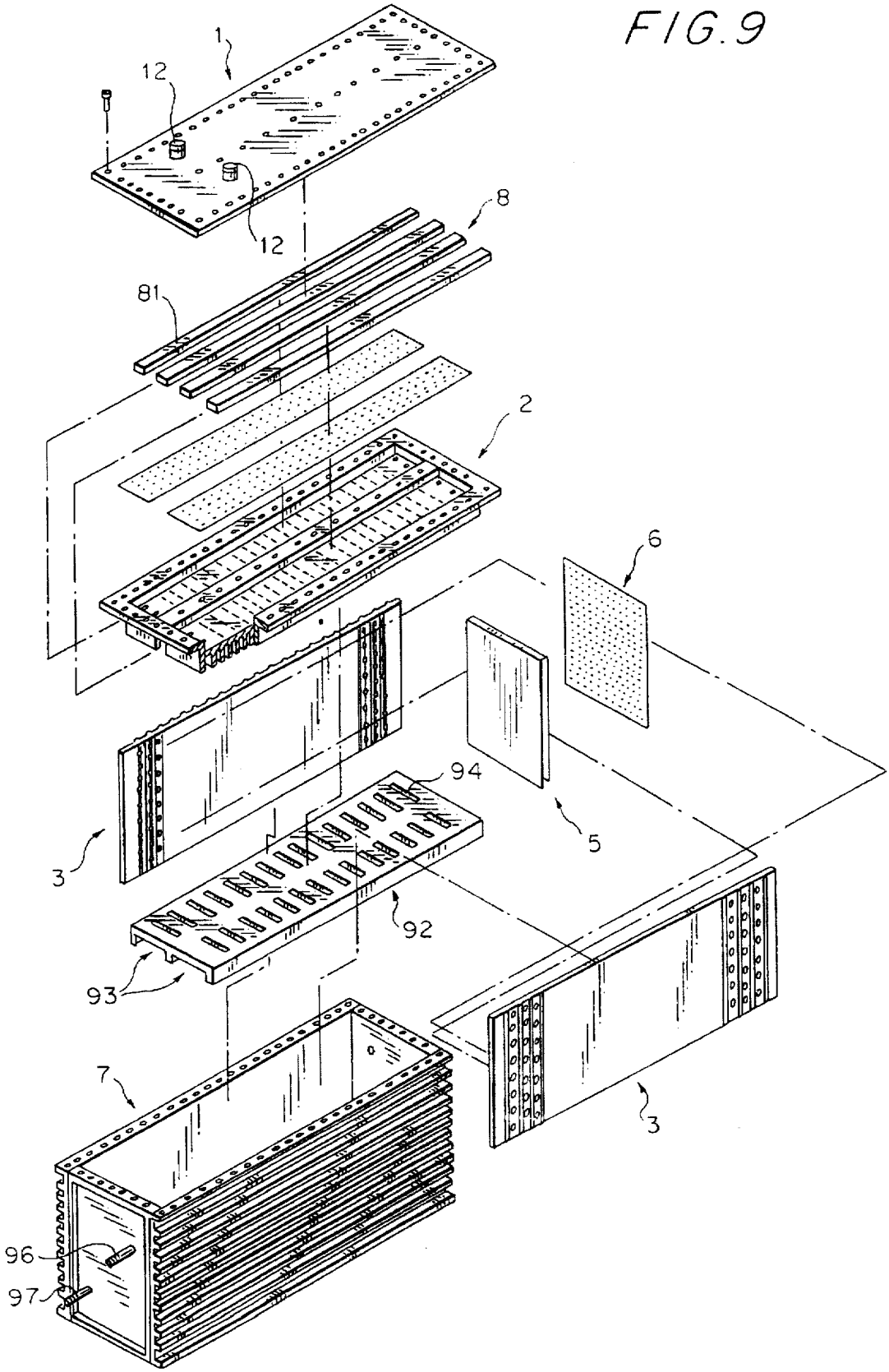
FIG. 9 is a perspective diagram showing the exploded components of a third embodiment of the present invention.

However, when electrolyte is filled into the electrolysis tank 7 undergoing electrolysis in the parallel form by way of the water container 9, in order to effectively control the electrolytic pressure in the individual electrolysis cells 73 for protection of the partition diaphragms 6 from damage, the structure of the hood bracket 2 is used in this case. Referring to FIGS. 8, 9, a separating board 92 having a E-shaped cross section and a plurality of parallel grooves 95 is provided with a pair of separated passages 93 on the underside thereof and the slots 94 above the two passages 93 are arranged alternatively between the parallel grooves 95 which are used to receive the bottom ends of the partition diaphragms 6.

Figure 10:
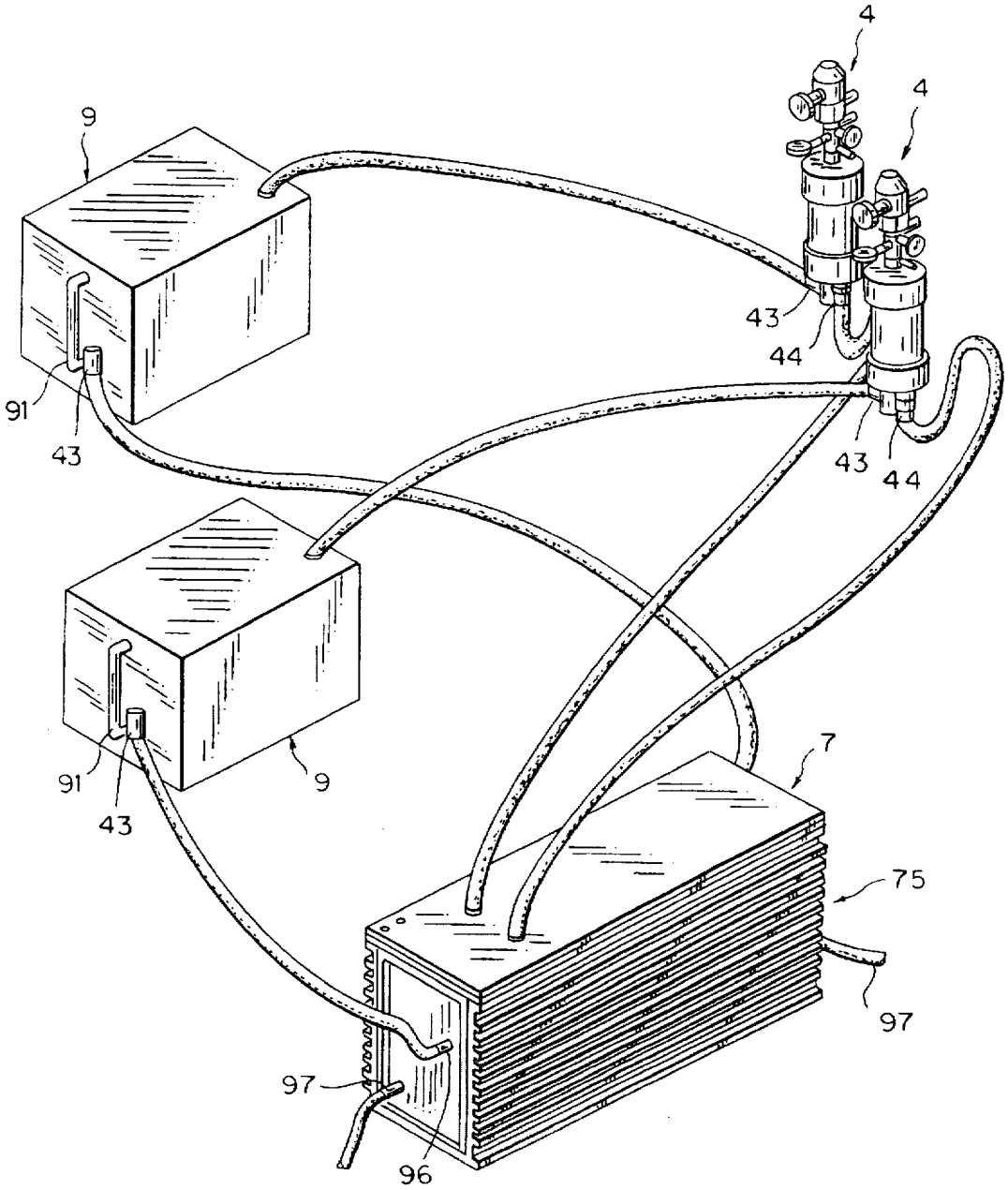
FIG. 10 is an assembly of the third embodiment.
Figure 11:
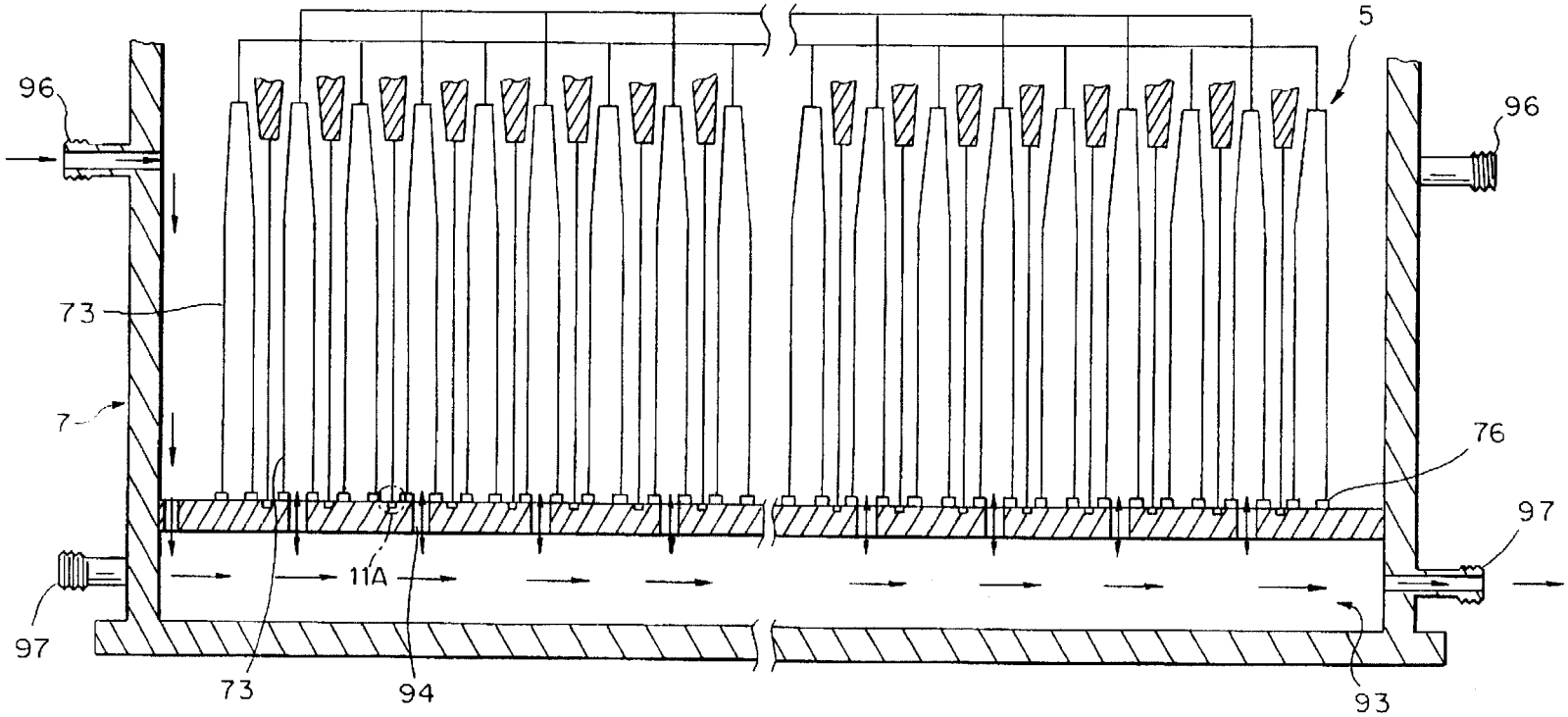
FIG. 11 is a diagram showing the operation mode of the separating board.
Figure 11A:
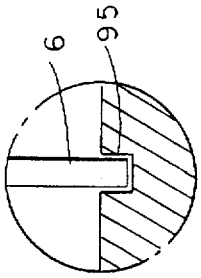
FIG. 11A is an enlarged view of circled area 11A in FIG. 11.
Figure 13A:
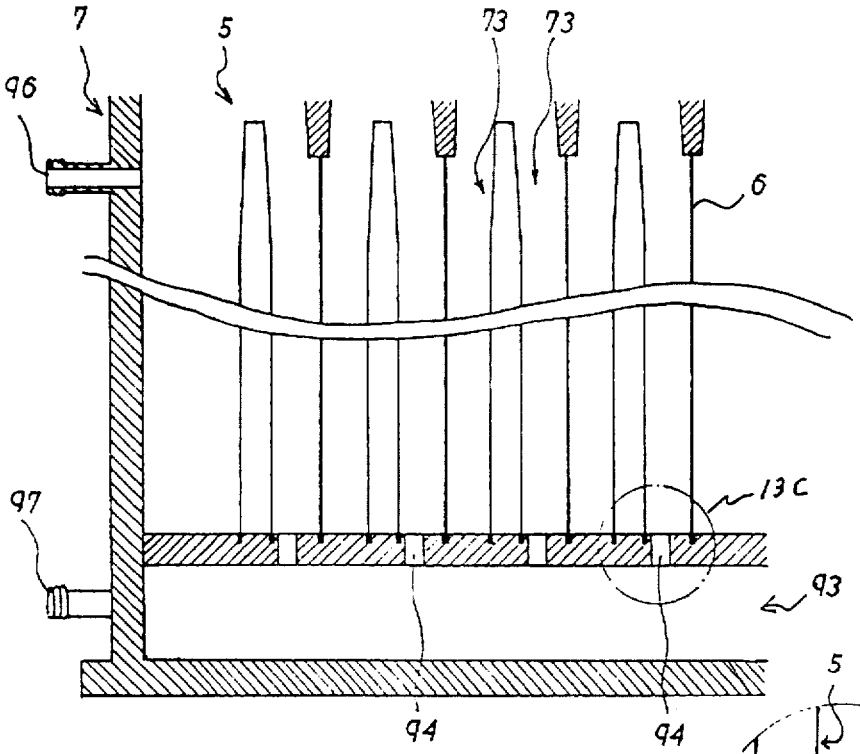
FIGS. 13A, 13B, are diagrams showing one further embodiment of the present invention.
Figure 13C:
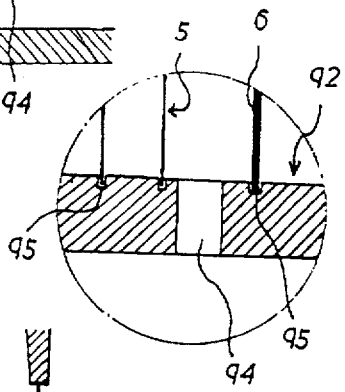
FIG. 13C is an enlarged view of circled area of 13C in FIG. 13A.
Figure 13B:
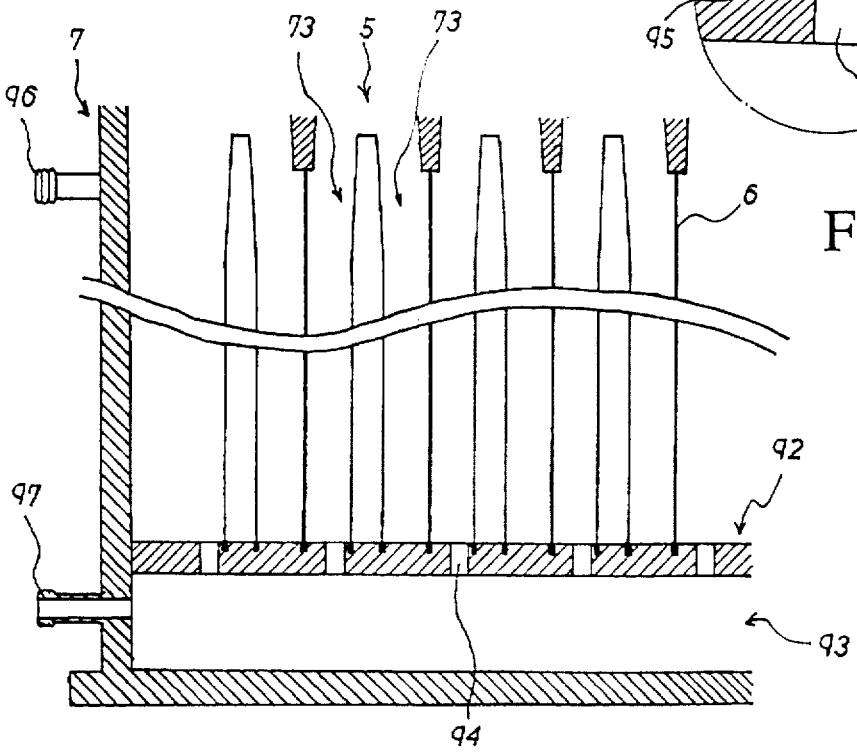

Furthermore, on the right and left portion of both sides of the electrolysis tank 7 are disposed separately a refilling tube 96 and a recollection tube 97. The refilling tube 96 on one side of tank 7 corresponds to the recollection tube 97 on the opposite side of the tank 7 so that two water containers 9 are connected to the refilling tubes 96 separately; and and the supplementary electrolyte can be directed from the two water containers 9 to the electrolysis tank and distributed via the plurality of slots 94 and into the passages 93, as shown in FIG. 10, effecting a fast mixing and diffusion of the electrolyte. Moreover, the electrolyte in the electrolysis cells 73 can be discharged separately via the recollection tubes 97, as shown in FIGS. 13A, 13B, 13C.

Figure 12:
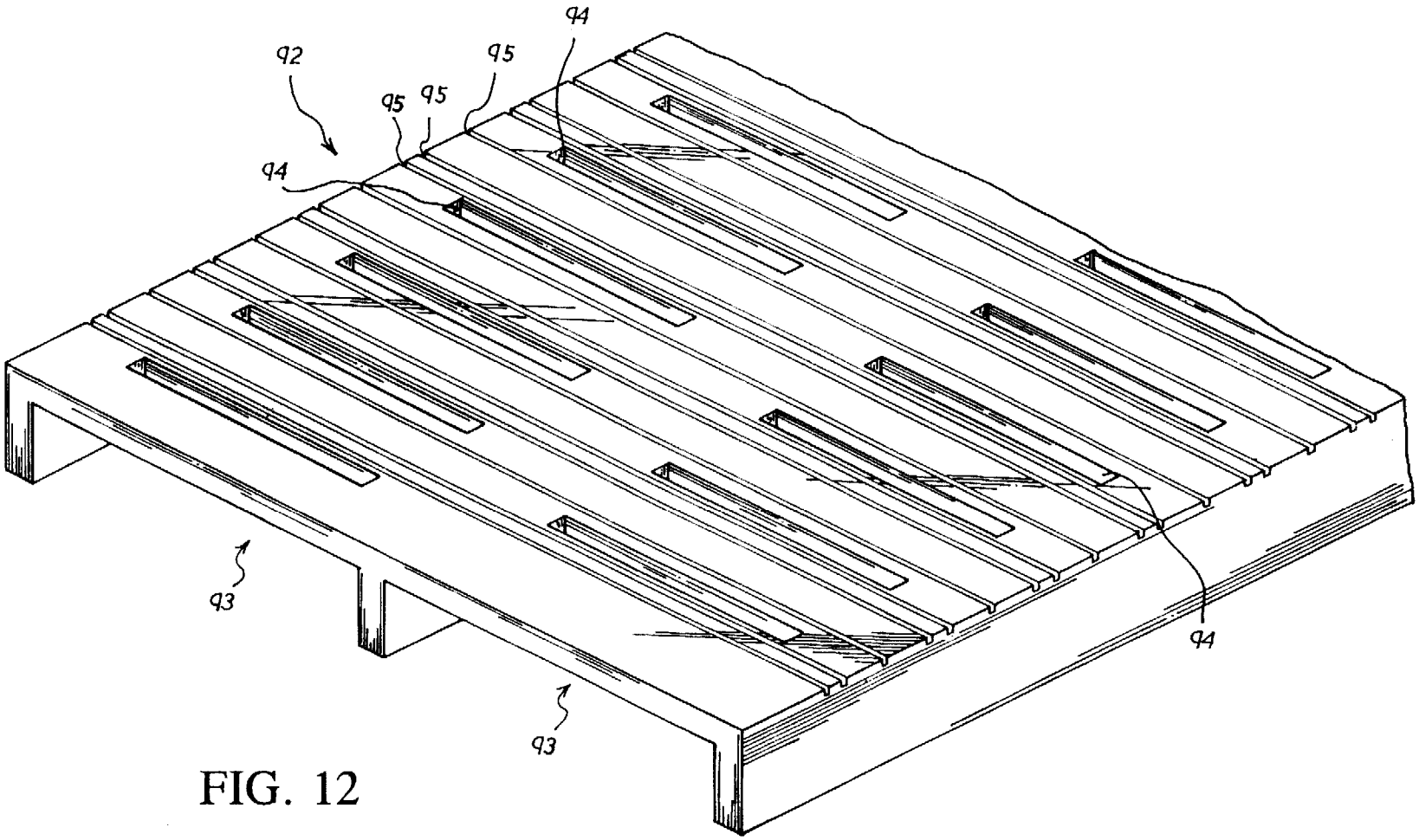
FIG. 12 is a diagram showing another design of the separating board.

Furthermore, when the separating board 92 is applied to a serially-arranged electrolysis tank, the slots 94 and the grooves 95 on the separating board 92 must be rearranged in a manner as illustrated in FIG. 12 wherein there are a combination of paired grooves 95 and a single groove 95 disposed in order on the separating board 92 with a single groove 95 located between every two paired grooves 95. And a slot 94 is placed to the right and left side of every single groove 95 at one end of the groove 95 alternatively, and so on so further. Thus, the electrode plates 5 (no cushion member 76 is used in this case) and the partition diaphragms 6 are located alternatively, rendering the electrolysis cells 73 in a non-communicating manner, as shown in FIGS. 13A, 13B, 13C.

I claim:

1. A gas producing high pressure electrolysis tank, comprising:

a top cover of a plane rectangular shape having a plurality of screw holes disposed on four parallel edges and the axial middle line thereof; an outlet disposed on each side of said axial middle line for mounting of a check valve respectively;

a hood bracket having a left and right degasing chamber on the top portion thereof that are not in communication with each other; having a plurality of downwardly protruded ribs that form a plurality of receiving grooves among one another; having a plurality of spaced screw holes disposed all over a peripheral flange thereof and a central division column having a plurality of screw holes disposed thereon that correspond to said screw holes on said top cover; said left and right degasing chambers having a plurality of degasing slots defined at each bottom face thereof respectively; said peripheral flange forming a surrounding wall enclosing said downwardly protruded ribs and receiving grooves; at each short side of said left and right degasing chambers being disposed a plurality of recollection holes; said degasing slots being placed in correspondence to every other of said receiving grooves;

a plurality of electrode plates each symmetrically folded into a clip form for saving material;

a plurality of partition diaphragms each disposed next to one of said electrode plates alternatively in assembly with said hood bracket and said partition diaphragms located just under said downwardly protruded ribs in end-to-end abutment relation;

a pair of mounting plates each having a plurality of spaced vertical ribs with a plurality of corresponding receiving ditches forming among said vertical ribs for mixedly housing said electrode plates and said partition diaphrams alternatively; a plurality of horizontal through holes each bridging a pair of neighboring vertical ribs; each said mounting plate being placed at one side of said electrolysis tank;

an electrolysis tank being a container and having a plurality of heat dissipating fins on external walls of said tank and having a plurality of screw holes disposed on the peripheral edge of said tank; having an electrolyte passing hole on one side thereof and a level controller disposed near the top of one side wall with an electromagnetic valve and pressure reducing valve at the bottom of the same side;

a pair of filter layers made of porous material each disposed on top of each said left and right degasing chamber respectively being retained in place by strips of weight block;

pressure control and recollection valve means each having a container to the top of which are mounted a pressure control valve, a pressure relief valve, a pressure operated switch, a pressure gauge, explosion-proof outlet; and at the bottom thereof being disposed a check valve controlled gas inlet and an electromagnetic valve connected to a water tank; said pressure operated switch automatically cutting off the general electric power supply as pressure differential being applied thereto;

said water tank adapted to hold electrolyte and being disposed between said electrolysis tank and said pressure control and recollection valve means and being provided with a level control means inside thereof for regulating the level of said electrolyte therein; an electromagnetic valve being disposed at the outlet of said tank; as said level control means detecting inadequacy of said electrolysis, the general power supply being cut off at once.

2. The electrolysis tank as claimed in claim 1 wherein said level controller in said electrolysis tank controls said electromagnetic valves of said electrolysis tank, said filter layers and said water tanks so as to make the same communicate with one another with the pressures therein identical, permitting the electrolyte in said water tank to be filled into and recollected from said electrolysis tank as a result of natural gravity.

3. The electrolysis tank as claimed in claim 1 wherein said mounting plates are provided with a plurality of densely spaced retaining grooves so as to produce as many electrolysis cells as possible and enhance the reaction areas of said electrode plates, making the efficiency and the operation pressure in said electrolysis tank high.

4. The electrolysis tank as claimed in claim 1 wherein said mounting plates are provided with a plurality of vertical ribs with a plurality of horizontal holes disposed on said vertical ribs adapted to make electrolyte in each of said electrolysis cells contact the inner wall of said electrolysis tank for dissipation of heat when electrolyte is present.

5. The electrolysis tank as claimed in claim 1 wherein a separating board is disposed at the bottom of said electrolysis tank for effectively controlling the pressures of said electrolysis cells connected in parallel when electrolyte is directed to said electrolysis tank; said separating board having an E-shaped cross section being provided with a pair of passages on the underside thereof; on said separating board are disposed a plurality of spaced grooves and a plurality of slots which are located above each said passage; and each said slot is disposed between two grooves with one disposed above one of said passages and the next one above the other passage alternatively so as to form two rows of spaced slots on said separating board; said partition diaphragms are engaged with said grooves; on both sides of said electrolysis tank are disposed a filling tube at the right upper portion and a recollection tube at the left lower portion thereof; each said filling tube disposed on one side of said electrolysis tank corresponds to said recollection tube disposed at the other side thereof whereby supplementary electrolyte can be filled by way of one of said filling tube and distributed via said slots into one corresponding passage in a quick mixing manner and the electrolyte in said electrolysis cells may be discharged via said recollection tube.

6. The electrolysis tank as claimed in claim 5 wherein said separating board housed in an electrolysis tank having serially connected electrolysis cells is provided with a plurality of combinations of paired grooves and a single groove arranged alternatively on said separating board with said slots disposed on either side of every single groove and each said slot is located above each said passage alternatively so that electrode plates and partition diaphragms can be inserted in said grooves respectively in such a manner that said electrolysis cells are separated without communication to one another.

* * * * *